US005378505A

United States Patent [19]

Kubota et al.

[11] Patent Number: 5,378,505

[45] Date of Patent: Jan. 3, 1995

[54] METHOD OF AND APPARATUS FOR ELECTROSTATICALLY SPRAY-COATING WORK WITH PAINT

[75] Inventors: Toshio Kubota; Niichi Toyama; Hiroshi Arai; Ichirou Ishibashi; Yukihito Ono, all of Sayama, Japan

[73] Assignee: Honda Giken Kogyo Kabushiki Kaisha, Tokyo, Japan

[21] Appl. No.: 112,059

[22] Filed: Aug. 26, 1993

Related U.S. Application Data

[63] Continuation of Ser. No. 833,667, Feb. 11, 1992, abandoned.

[30] Foreign Application Priority Data

Feb. 27, 1991 [JP] Japan ..... 3-009829[U]
Feb. 27, 1991 [JP] Japan ..... 3-033049

[51] Int. Cl.[6] ..... B05D 1/04; B05D 5/02; B05D 15/02

[52] U.S. Cl. ..... 427/484; 427/485; 118/302; 118/626

[58] Field of Search ..... 118/626, 302; 427/480, 427/484, 485, 486

[56] References Cited

U.S. PATENT DOCUMENTS 3,205,853 9/1965 Wampler et al. ..... 118/626 X
4,232,055 11/1980 Shaffer ..... 427/483
4,597,983 7/1986 Kühne et al. ..... 427/485
4,813,603 3/1989 Takeuchi et al. ..... 239/113
4,932,589 6/1990 Diana ..... 118/302 X

FOREIGN PATENT DOCUMENTS 8009123 11/1980 France .
3440381 5/1986 Germany .
257994 12/1990 Japan .
2084048 4/1982 United Kingdom .

OTHER PUBLICATIONS

Patent Abstracts of Japan, vol. 016, No. 466 (C-0989) 28 Sep. 1992 & JP-A-41 66 253 (Nissan Motor Co., Ltd.) 12 Jun. 1992.

Patent Abstracts of Japan, vol. 004, No. 081 (C-014) 11 Jun. 1980 & JP-A-55 047 161 (Nippon Ranzubaagu KK) 3 Apr. 1980.

*Primary Examiner*—Marianne Padgett

[57] ABSTRACT

A herein is a method of and an apparatus for electrostatically spray-coating a workpiece with electrically-conductive paint. The workpiece is first sprayed with the paint directly subjected to a high voltage from a rotatable atomizing type spray gun so as to electrostatically coat the work with the paint. Thereafter, cleaning liquid is supplied to a rotatable atomizing head through a line for washing after completion of the electrostatic spray coating process so as to clean the rotatable atomizing head. Further, after the rotatable atomizing head has been washed, the line is dried, and the next electrostatic spray coating process is carried out after the line has been dried. The spray gun includes an inner line as a path, for supplying the paint to the rotatable atomizing head, and an outer line as a path used for washing, for supplying the cleaning liquid used to wash the rotatable atomizing head. The inner line oriented toward the rotatable atomizing head has a terminal which projects forward from a terminal of the outer line.

1 Claim, 4 Drawing Sheets

METHOD OF AND APPARATUS FOR ELECTROSTATICALLY SPRAY-COATING WORK WITH PAINT

This application is a continuation, of application Ser. No. 07/833,667 filed on Feb. 11, 1992, now abandoned.

BACKGROUND OF THE INVENTION

1. Field of the Invention

The present invention relates to a method of and an apparatus for electrostatically spray-coating a workpiece with electrically-conductive paint directly subjected to a high voltage by using a rotatable atomizing type spray gun.

2. Description of the Related Art

As a method of applying a high voltage to electrically-conductive paint so as to electrostatically spray-coat an object or work such as a vehicle body with the paint, there has heretofore been known a voltage blocking method, for example. According to this method, the paint is first introduced into an intermediate reservoir electrically insulated from ground potential. Thereafter, the paint is supplied via a paint line to a spray gun which is at high potential from the intermediate reservoir, thereby electrostatically spray-coating the workpiece with the paint.

When a rotatable atomizing type spray gun having a rotatable cup (corresponding to a rotatable atomizing head) is used as the spray gun in the above method, water-based paint, if used as the electrically-conductive paint, tends to adhere to the rotatable cup so as to form a dry film thereon. This dry film then separates from the rotatable cup and adheres to the workpiece being coated, thereby causing a painting failure.

As has been disclosed in Japanese Patent Application Publication No. 2-57994, for example, there has been known a method of intermittently supplying cleaning liquid to a rotatable cup so as to clean or wash the rotatable cup while a workpiece is being electrostatically spray-coated with paint.

In the above disclosure, however, the cleaning liquid has been supplied intermittently to the rotatable cup. Therefore, an undesired flow of electricity through the cleaning liquid tends to occur when a high voltage is directly applied to the water-based paint to carry out an electrostatic spray coating or painting process. Accordingly, the voltage applied to the water-based paint is unstable, and the workpiece which has been electrostatically spray-coated with the paint becomes inferior in quality owing to impairment in the efficiency of the application of the paint to the workpiece. In addition, the voltage to be applied to the paint is greatly reduced, so that an electrostatic spray coating process cannot be carried out.

Further, in the above disclosure, the dry film produced by the paint is prevented from being applied to and deposited on an inner peripheral wall of the rotatable cup by coupling a paint feed pipe and a water feed pipe for washing to the rotatable cup and supplying cleaning liquid to the rotatable cup from the water feed pipe by a water feed valve.

However, a tip portion and an outer surface of the water feed pipe cannot be cleaned, and the cleaning liquid is supplied intermittently to the rotatable cup. Therefore, water or moisture on the tip portion and the outer surface of the water feed pipe evaporates to dryness while the supply of the cleaning liquid to the rotatable cup is being stopped, thus allowing the formation of solid materials such as a dry film produced by the water-based paint, etc., thereby causing a problem in that these solid materials are then applied to the workpiece. As a result, continuous painting cannot be carried out using the water-based paint, and items to be electrostatically spray-coated with the paint cannot be mass-produced.

SUMMARY OF THE INVENTION

It is a principal object of the present invention to provide a method of and an apparatus for electrostatically spray-coating a workpiece with electrically-conductive paint wherein a rotatable atomizing head can be cleaned effectively and an undesired flow of electricity produced through cleaning liquid can be avoided reliably when a high voltage is applied to the paint.

It is a principal object of the present invention to provide an apparatus for electrostatically spray-coating a workpiece with paint, which includes a dual line having a line for supplying water-based paint to a spray gun and a line for supplying cleaning liquid, and can prevent a dry film from being applied to and deposited on a terminal of the water-based paint feed line, and to provide a method of electrostatically spray-coating a workpiece with paint.

It is another object of the present invention to provide a method of electrostatically spray-coating a workpiece with electrically-conductive paint, the method comprising the following steps of spraying the workpiece with electrically-conductive paint directly subjected to a high voltage from a rotatable atomizing type spray gun thereby to electrostatically coat said workpiece with the paint, supplying cleaning liquid to a rotatable atomizing head via a line for cleaning after the electrostatic spray coating process has been completed, thereby washing the rotatable atomizing head, drying the line after the rotatable atomizing head has been washed, and carrying out the next electrostatic spray coating process after the line has been dried.

It is a further object of the present invention to provide a method of electrostatically spray-coating a workpiece with electrically-conductive paint wherein after the rotatable atomizing head has been washed, dry air is supplied to the line so as to dry the line.

It is a still further object of the present invention to provide a method of electrostatically spray-coating a work with electrically-conductive paint, the method comprising the following steps of spraying a work with electrically-conductive paint directly subjected to a high voltage from a rotatable atomizing type spray gun thereby to electrostatically coat said work with the paint, supplying cleaning liquid to a rotatable atomizing head via a line for cleaning after the electrostatic spray coating process has been completed, thereby washing the rotatable atomizing head, supplying air under given pressure to the line after the rotatable atomizing head has been washed, thereby discharging the cleaning liquid which remains in the line to the outside, supplying air under pressure higher than the given pressure to the line so as to dry the line, and carrying out the next electrostatic spray coating process after the line has been dried.

It is a still further object of the present invention to provide an apparatus for supplying water-based paint directly subjected to a high voltage to a spray gun so as to electrostatically spray-coat a work with the paint, the apparatus comprising an inner line for supplying water-based paint to the spray gun, and an outer line for supplying cleaning liquid used to wash a rotatable atomizing head, the inner line directed toward the rotatable atomizing head having a terminal which projects frontward from a terminal of the outer line.

It is a still further object of the present invention to provide an electrostatic spray coating apparatus wherein the outer line is coupled to a valve mechanism for selectively supplying the cleaning liquid used to clean the rotatable atomizing head and dry air used to dry the outer line.

It is a still further object of the present invention to provide an electrostatic spray coating apparatus further including a valve mechanism for selectively supplying dry air under given pressure and dry air under pressure higher than the given pressure to the outer line.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

A method of and an apparatus for electrostatically spray-coating an object or workpiece with paint will be described below in detail with reference to the accompanying drawings in which preferred embodiments of the present invention are shown by way of example.

Figure 2:
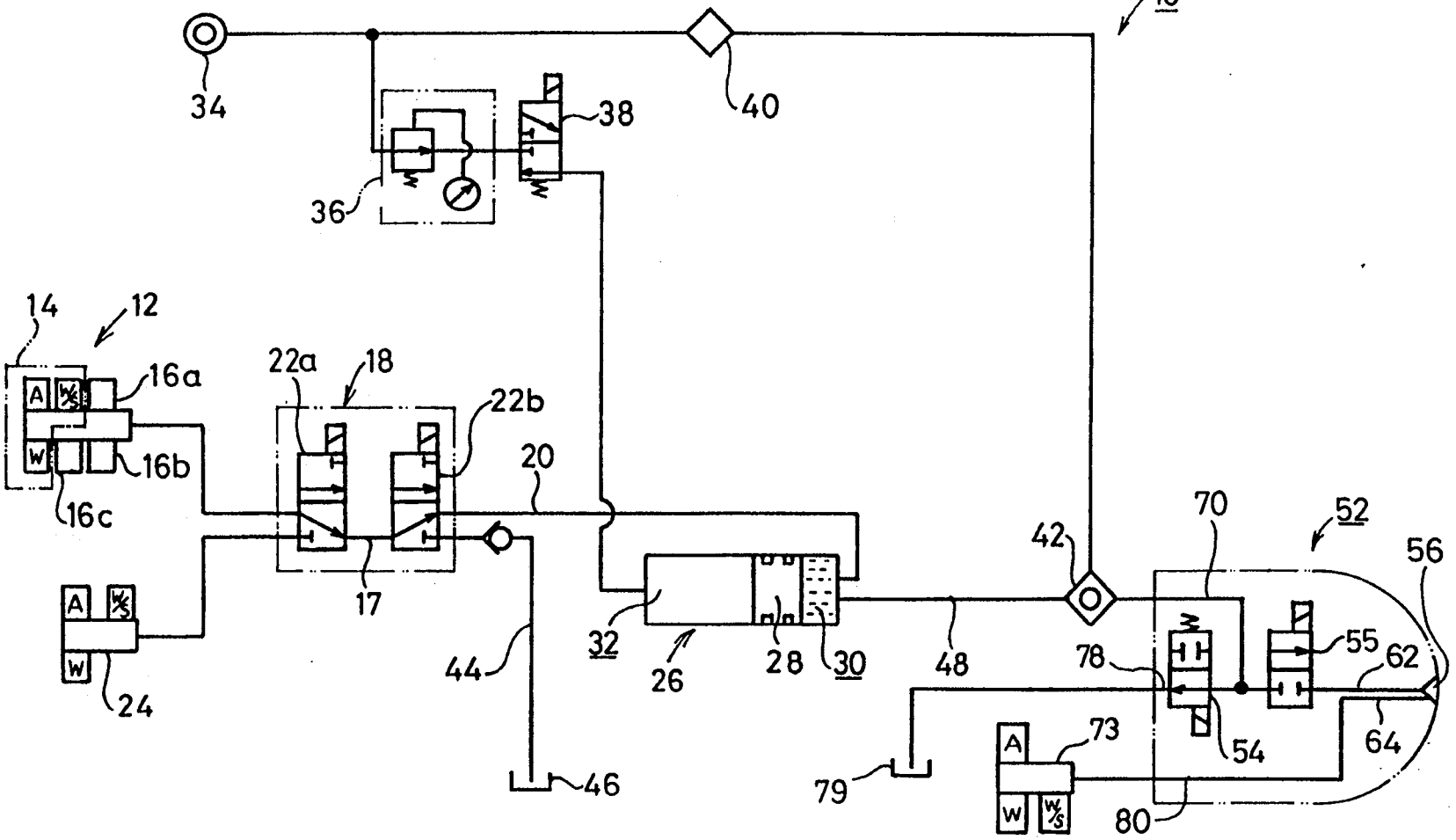
FIG. 2 is a view schematically showing the structure of the electrostatic spray coating apparatus.

In FIG. 2, an electrostatic spray coating or painting apparatus 10 is provided for carrying out an electrostatic spray coating method according to the present invention. The electrostatic spray coating apparatus 10 has a grounded color changeover valve mechanism 12 comprising a first flush valve 14 for controlling the supply of air (A), water (W) and cleaning or washing liquid (S) or the like and a plurality of paint valves 16*a* through 16*c* capable of supplying electrically-conductive paint different in color. Coupled to the color changeover valve mechanism 12 is a feed line 20 including an electrical insulating line 17 made of a resin such as polytetrafluoroethylene (PTFE) and a block valve mechanism 18 having the line 17, which are disposed in at least a part thereof.

The block valve mechanism 18 has two changeover valves 22*a*, 22*b*. In addition, the block valve mechanism 18 is actuated to cause the changeover valve 22*a* on the side of an inlet thereof to select either one of the color changeover mechanism 12 and a second flush valve 24 for controlling the supply of air (A), water (W) and cleaning liquid (S) or the like. Accordingly, the block valve mechanism 18 communicates with an intermediate reservoir 26 by the feed line 20. The intermediate reservoir 26 comprises a first cylinder chamber 30 compartmented by a piston 28 and used for the injection of water-based electrically-conductive paint and cleaning or washing liquid, and a second cylinder chamber 32 for the supply of air. An air feed source 34 communicates with the second cylinder chamber 32 through a flow control valve 36 and an on-off valve 38. The air feed source 34 is coupled via a booster 40 to a paint flow control device 42 for controlling the pressure of air. The paint flow control device 42 serves to control the delivery rate of electrically-conductive paint. The changeover valve 22*b* is coupled to a waste-liquid tank 46 through a discharge line 44.

A spray gun 52 is coupled via a delivery line 48 to the first cylinder chamber 30 of the intermediate reservoir 26. In addition, the spray gun 52 has a dump valve 54 and a trigger valve 55, and is coupled to an unillustrated high-voltage applying means.

Figure 1:
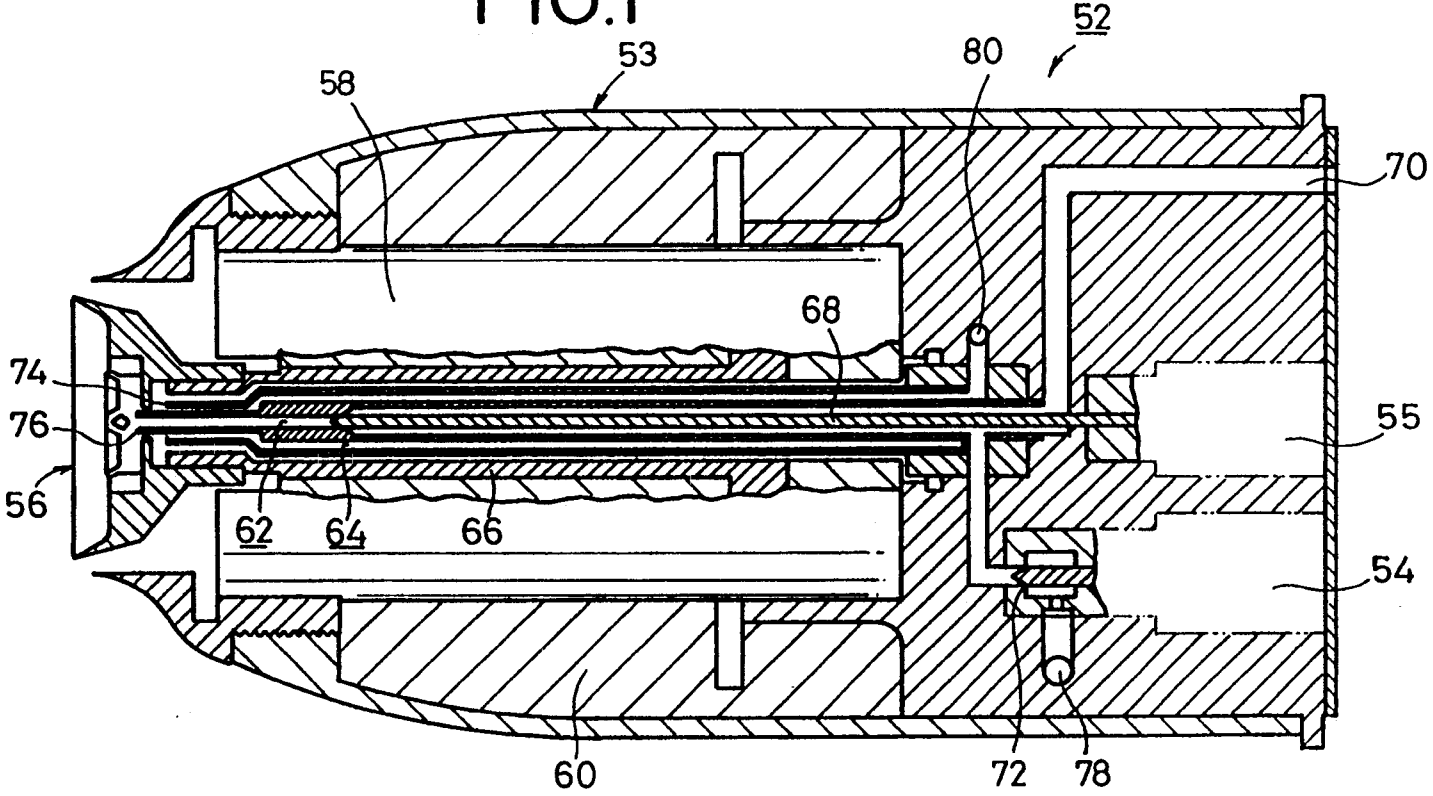
FIG. 1 is a vertical cross-sectional view showing a spray gun of an electrostatic spray coating apparatus for carrying out an electrostatic spray coating method according to a first embodiment of the present invention.

As shown in FIG. 1, the spray gun 52 comprises a body 53 shaped substantially in the form of a cylinder and having an end whose diameter is small, and a rotatable cup (rotatable atomizing head) 56 shaped in the form of a taper. There are disposed in the body 53 an air motor 58, a support member 60 for fixing the air motor 58, an inner pipe or line (inner path) 62 as a path, for supplying electrically-conductive paint to the rotatable cup 56, an outer pipe or line (outer path) 64 which has the inner line 62 included therein and serves as a path for washing, for supplying cleaning liquid to clean or wash the rotatable cup 56, a rotator 66 which has the outer line 64 included therein and is threadedly inserted into and coupled to the rotatable cup 56, a trigger valve 55 for enabling a needle 68 to open and close the inner line 62, and a dump valve 54 for enabling a needle 72 to discharge electrically-conductive paint fed under pressure from a connecting port 70 communicating with the delivery line 48 to the outside. The inner line 62 and the outer line 64 are provided coaxially with each other so as to form a dual or double line. Referring now to both FIGS. 1 and 2, a third flush valve (valve mechanism) 73 for controlling the supply of air (A), water (W) and cleaning liquid (S) or the like is coupled to the outer line 64 through a path or line 80.

A tip portion (terminal) 76 of the inner line 62 projects toward the rotatable cup 56 and projects frontward from a terminal 74 of the outer line 64 as the path for supplying the cleaning liquid. A port 78 for discharging water-based paint therethrough, which communicates with the inner line 62, is coupled to a waste-liquid tank 79.

Figure 3:
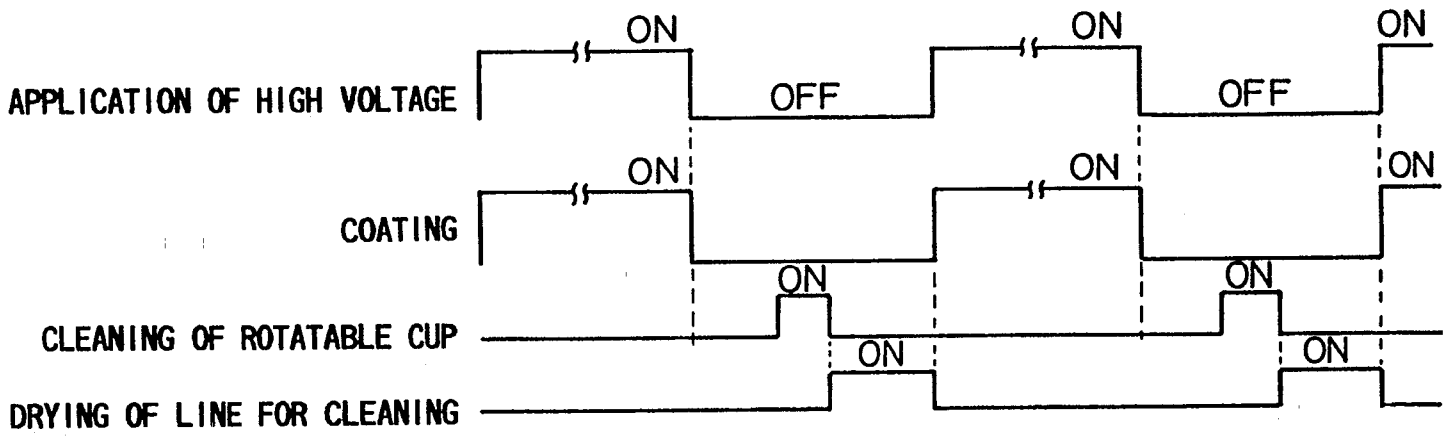
FIG. 3 is a timing chart for describing the operation of the electrostatic spray coating apparatus for performing the electrostatic spray coating method.

The operation of the electrostatic spray coating apparatus constructed as described above will now be described below with reference to a timing chart shown in FIG. 3 in connection with the electrostatic spray coating method according to the first embodiment.

First of all, electrically-conductive paint of a given color is fed under pressure from a paint valve 16*a* of the color changeover valve mechanism 12 so as to be loaded in the first cylinder chamber 30 of the intermediate reservoir 26 through the feed line 20. Further, the paint is supplied to the spray gun 52 via the delivery line 48. Upon charging of the spray gun 52 with the paint, the trigger valve 55 is actuated to cause the needle 68 to close the inner line 62, and the dump valve 54 is actuated to cause the needle 72 to open the discharge port 78. After the spray gun 52 has been charged with the paint, the dump valve 54 is closed.

When the changeover valves 22a, 22b of the block valve mechanism 18 are switched, the second flush valve 24 is actuated to wash or clean the block valve mechanism 18. Thereafter, cleaning liquid and water used for the cleaning of the block valve mechanism 18 are discharged into the waste-liquid tank 46 via the discharge line 44. Then, the block valve mechanism 18 is dried, so that the color changeover valve mechanism 12 and the intermediate reservoir 26 are electrically insulated from each other.

Then, drive air is supplied from the air feed source 34 to the second cylinder chamber 32 of the intermediate reservoir 26 by the flow control valve 36 and the on-off valve 38 so as to displace the piston 28 toward the first cylinder chamber 30. As a consequence, the electrically-conductive paint introduced from the connecting port 70 is discharged from the tip portion 76 via the inner line 62 under the on-action of the trigger valve 56 in a state in which a high voltage is being applied to the paint. At this time, the air motor 58 is energized to rotate the rotator 66. Hence, the rotatable cup 56 coupled to the rotator 66 is also rotated correspondingly. Thus, an unillustrated object or work is coated with the paint applied from the spray gun 52 in the form of a spray by the synergetic effect of the electric field of high force which exists in the space around the paint with the high voltage being directly applied thereto and the rotation of the rotator 66.

The application of the high voltage to the paint is stopped after the object has electrostatically been coated with the paint. Thus, the third flush valve 73 is actuated to supply cleaning liquid to the line 80. Then, the cleaning liquid is delivered to an inner peripheral portion of the rotatable cup 56 from the terminal 74 of the outer line 64 through the outer line 64 so as to remove the paint applied to the inner peripheral portion of the rotatable cup 56 by washing. In addition, an outer peripheral portion of the tip portion 76 of the inner line 62, which projects frontward from the terminal 74 of the outer line 64, can also be washed by the cleaning liquid. The washing process is carried out for a given period of time, thereby making it possible to prevent the paint from being applied to and dried at the rotatable cup 56 and the tip portion 76.

After the washing process has been completed, the third flush valve 73 is actuated to supply dry air to the line 80 only for a predetermined period of time so as to dry the inside of the outer line 64. Further, the next electrostatic spray coating process is carried out based on the above-mentioned procedure.

In the present embodiment, after the rotatable cup 56 has been washed by the cleaning liquid supplied from the line 80 to the outer line 64, dry air is supplied to the line 80 so as to dry the outer line 64. It is therefore possible to effectively avoid an undesired flow of electricity produced through the outer line 64 when the high voltage is applied to the electrically-conductive paint supplied to the inner line 62. As a result, a predetermined high voltage can reliably be applied to the paint in the inner line 62. In addition, a process for electrostatically spray-coating an object or workpiece to be coated (not shown) with the paint under the rotation of the rotatable cup 56 can highly accurately and efficiently be carried out.

Figure 4:
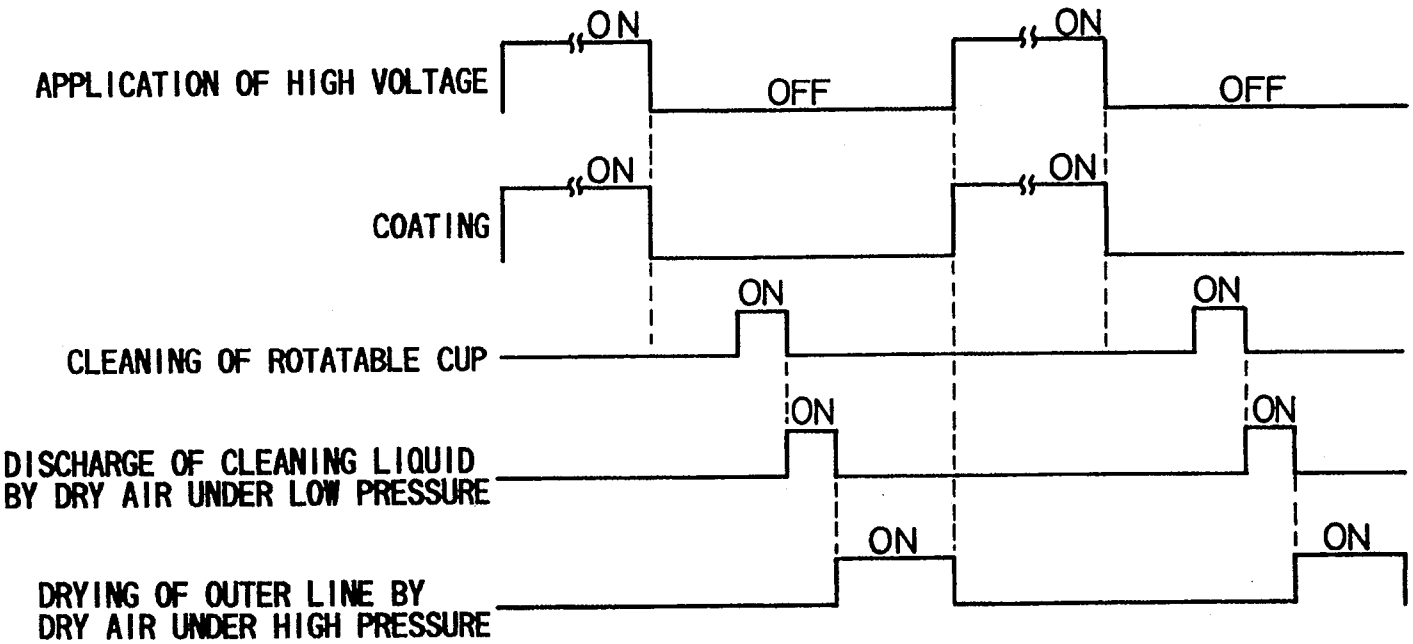
FIG. 4 is a timing chart for describing the operation of an electrostatic spray coating apparatus for carrying out an electrostatic spray coating method according to a second embodiment of the present invention.

An electrostatic spray coating method according to a second embodiment will now be described below with reference to a timing chart shown in FIG. 4.

In a manner similar to the first embodiment, electrically-conductive paint of a given color, which has been fed under pressure from a paint valve 16a of a color changeover valve mechanism 12, is first loaded in a first cylinder chamber 30 of an intermediate reservoir 26. Further, the paint is supplied to a spray gun 52 via a delivery line 48 until it is fully charged with the paint. Then, the block valve mechanism 18 is switched to electrically insulate the color changeover valve mechanism 12 and the intermediate reservoir 26 from each other.

Then, drive air is supplied to a second cylinder chamber 32 of the intermediate reservoir 26 from an air feed source 34. In addition, a high voltage is directly applied to the electrically-conductive paint. Therefore, an unillustrated object or workpiece is sprayed with the electrically-conductive paint, thereby enabling an electrostatic spray coating process. The application of the high voltage to the paint is stopped after the electrostatic spray coating process has been completed. Accordingly, a third flush valve 73 is actuated to wash a rotatable cup 56 only for a given period of time.

After the rotatable cup 56 has been washed, the third flush valve 73 is actuated to supply dry air under given pressure to an outer line 64 from a line 80 only for a predetermined period of time, thereby discharging the cleaning liquid which remains in the outer line 64 from the rotatable cup 56 to the outside. When the dry air is set to pressures of 5 to 10 ($kg/cm^2$) in such a manner as to be used for a normal air blow, the delivery rate of the cleaning liquid increases to 2000 (cc/min) or greater. However, the amount of the cleaning liquid, which can be discharged from the rotatable cup 56, is normally set to 300 to 700 (cc/min) according to the normal delivery rate of the paint. There is a possibility of the cleaning liquid which is not discharged from the rotatable cup 56 to the outside flowing backward into an unillustrated turbine of an air motor 58, for example in a state in which a high voltage is being applied to the cleaning liquid. As a result, the turbine cannot be rotated at a predetermined rotational speed. It is impossible to rotate the turbine in the worst case.

In the present embodiment, dry air under relatively low pressures of 0.2 to 0.7 ($kg/cm^2$) is therefore used to discharge the cleaning liquid in the outer line 64, thereby making it possible to smoothly and reliably discharge the cleaning liquid remaining in the outer line 64 to the outside from the rotatable cup 56.

Then, dry air under pressures of 5 to 7 ($kg/cm^2$) is supplied to the outer line 64 from the line 80 so as to dry the inside of the outer line 64. Thereafter, the next electrostatic spray coating process is performed in accordance with the above-described procedure.

As described above, after the rotatable cup 56 has been washed with the cleaning liquid supplied to the outer line 64 from the line 80, the dry air is supplied to the outer line 64 so as to dry the inside of the outer line 64. Thus, when the high voltage is directly applied to the electrically-conductive paint supplied to the inner line 62, the undesired flow of electricity through the outer line 64 can effectively be avoided. As a result, a given high voltage can reliably be applied to the electrically-conductive paint in the inner line 62. In addition, a process for electrostatically spray-coating an object or work (not shown) with the paint under the rotation of the rotatable cup 56 can highly accurately and efficiently be carried out. When the dry air to be supplied is set to a relatively high pressure after the cleaning liquid remaining in the outer line 64 has been discharged to the outside, the time for drying the outer line 64 can easily be reduced.

The electrostatic spray coating method according to the present invention can bring about the following advantageous effects.

After an electrostatic spray coating process has been completed, cleaning liquid is supplied to a rotatable atomizing head via a line used for washing in such a manner that the head is washed. Then, the line is dried after the head has been cleaned. It is therefore possible to reliably avoid an undesired flow of electricity produced through the line when a high voltage is applied to electrically-conductive paint to carry out the next electrostatic spray coating process. As a result, a predetermined high voltage can reliably be applied to the paint, and an electrostatic spray coating process can highly accurately and efficiently be carried out.

Further, after the above-described cleaning process has been completed, air under a relatively low pressure is first used to discharge the cleaning liquid which remains in the line to the outside. It is also possible to prevent the remaining cleaning liquid from flowing backward into a turbine of a motor, for example. As a result, a predetermined high voltage can reliably be ensured, and an electrostatic spray coating process can highly accurately and efficiently be carried out.

According to an electrostatic spray coating apparatus of the present invention, as well, a spray gun has an inner line for supplying water-based paint to a rotatable atomizing head, and a cleaning-liquid feeding outer line for cleaning the rotatable atomizing head and the outer surface of the open terminal of the inner line. The terminal of the inner line projects toward the rotatable atomizing head in such a manner as to extend frontward from the outer line. Therefore, materials such as paint applied to the terminal of the inner line can reliably be removed with cleaning liquid discharged from a terminal of the outer line.

Having now fully described the invention, it will be apparent to those skilled in the art that many changes and modifications can be made without departing from the spirit or scope of the invention as set forth herein.

What is claimed is:

1. A method of electrostatically spray-coating a workpiece with electrically-conductive paint subjected to a voltage using a spray gun, said spray gun having a rotatable atomizing head attached to a rotator for rotating said atomizing head, a paint supply line for supplying said paint to said atomizing head, and a cleaning line for supplying cleaning liquid and air, where the air is under a pressure, to said atomizing head, said rotator having a path for accommodating said paint supply line and said cleaning line therein, said path being formed in a cylindrical shape along a rotative axis of said rotator, said cleaning line being disposed coaxially in said path, with an end opening thereof disposed in said atomizing head, said paint supply line being disposed coaxially within said cleaning line and having a nozzle tip thereof projecting frontward from said end opening of said cleaning line into the center of said atomizing head, preventing liquid communication between said cleaning line, the method comprising the steps of:

electrostatically spray-coating the workpiece with said paint;

supplying said cleaning liquid to said atomizing head via said cleaning line to wash said atomizing head after said spray-coating;

supplying the air to said cleaning line after washing said atomizing head, to discharge said cleaning liquid remaining in said cleaning line through said atomizing head, at a delivery rate within a rate of spraying said paint during said spray-coating; and drying said cleaning line before spray-coating a next workpiece, to prevent voltage leakage, with air under pressure higher than an air pressure used for discharging the remaining cleaning liquid.

* * * * *